United States Patent [19]

Bartolini

[11] Patent Number: 4,529,463

[45] Date of Patent: Jul. 16, 1985

[54] PROCESS AND APPARATUS FOR THE MANUFACTURE OF ADJUSTABLE SHOULDER-STRAPS FOR CLOTHING

[75] Inventor: Dario Bartolini, Impruneta, Italy

[73] Assignee: Lovable Industriale S.p.A., Grassobbio, Italy

[21] Appl. No.: 590,622

[22] Filed: Mar. 19, 1984

[30] Foreign Application Priority Data

Mar. 17, 1983 [IT] Italy ..... 20119 A/83

[51] Int. Cl.[3] ..... B31F 1/00; A41H 43/00

[52] U.S. Cl. ..... 156/226; 156/443; 233/49

[58] Field of Search ..... 156/443, 475, 226, 227; 223/49, 37; 128/510-511, 516

[56] References Cited

U.S. PATENT DOCUMENTS

| | | | |
|---|---|---|---|
| 2,699,275 | 1/1955 | Mulligan | 223/49 |
| 2,955,730 | 10/1960 | Sountag et al. | 223/49 |
| 3,033,728 | 5/1962 | Block et al. | 223/49 X |
| 3,150,804 | 9/1964 | Edelman | 223/49 |
| 3,587,947 | 6/1971 | Block et al. | 223/49 |
| 3,785,907 | 1/1974 | Barr et al. | 223/49 X |

FOREIGN PATENT DOCUMENTS

| | | |
|---|---|---|
| 2394259 | 1/1979 | France . |
| 2420311 | 10/1979 | France . |
| 2515009 | 4/1983 | France . |
| 1547576 | 6/1979 | United Kingdom . |
| 1547578 | 6/1979 | United Kingdom . |
| 2041998 | 9/1980 | United Kingdom . |

*Primary Examiner*—David Simmons

*Attorney, Agent, or Firm*—Young & Thompson

[57] ABSTRACT

An apparatus for the manufacture of shoulder-straps including ribbon, ring and slider comprises a ribbon feeding unit, a slider supplying unit, a sealing unit for sealing the slider to the ribbon, a ribbon translation and turnover unit and an insertion unit for inserting the ribbon into the slider; preferably comprises a ring supplying and deforming unit and a means for ribbon spreading following insertion in the slider. According to the process, the ribbon is slipped into the intentionally deformed ring, sealed to the slider, bent over on itself and inserted into the slider by a punch; a further punch provides for stretching out the ribbon as left in the slider by the first punch.

18 Claims, 27 Drawing Figures

PROCESS AND APPARATUS FOR THE MANUFACTURE OF ADJUSTABLE SHOULDER-STRAPS FOR CLOTHING

This application relates to the manufacture of clothing, particularly brassieres.

Most of brassieres at present in use have shoulder-straps of adjustable length, made of elastic or non elastic cloth or fabric ribbon. In such shoulder-straps the ribbon is bent in loop-like form, a ring or similar means is slipped on the ribbon loop and a slider, generally a two-slot type of slider, is fixed to a ribbon end and slidable with the double slot on another portion of the ribbon forming said loop. The ring is then secured to another ribbon or to a cloth border, generally fixed to a brassiere cup. By sliding the slider on the ribbon, the shoulder-strap comprising the same can be either elongated or shortened.

At present, assembling of shoulder-straps is manually effected. An operator cuts a ribbon section of predetermined length, slips or threads a first end of the ribbon into the ring, and slides the ring on the ribbon for some length; then the slips or threads said ribbon end into the slider, folds up said ribbon end on itself and fixes it by sewing; then he takes a second end of the ribbon and slips or threads it first in one and then into the other slider slot, so that it remains at sliding condition; thus a shoulder-strap is ready for application to a brassiere.

From the foregoing it clearly appears that a manual process involves a substantial use of labour and is highly time consuming and accordingly expensive.

An earlier application of the same applicant describes a ribbon slider comprising an anchoring portion with projections for sealing or welding, for example ultrasonic welding, and a double slot, the two slots being separated by a bridge portion comprising two arms extended to each other, and resiliently flexible in a plate at right angles to the slider plane. Said application also describes an automatic process for assembling a slider and a ribbon, which process comprises the steps of sealing one end of the ribbon onto the slider, then introducing by a punch orthogonal to the slider a ribbon portion into the slider, and finally retracting the slider leaving the ribbon straddling on its arms.

The described process, although being a remarkable improvement from a technical point of view over the known art, however had some technical disadvantages and faults, rendering it poorly exploitable in practice; for example, on shoulder-strap assembling some labour was still involved for threading the ribbon into the ring; moreover, the ribbon, when slipped or threaded into the slider slots by the punch would then remain raised over the slots to form a loop thereover and had then to be manually retaken and lengthwise pulled or stretched to remove the loop.

Therefore, according to the present invention an improved automatic process is provided for complete machine assembling of a shoulder-strap and an apparatus is also provided for such an assembling without any manual operation.

A process according to the present invention, comprises under a first aspect the steps of slipping or threading a ribbon into a ring; sealing or welding one end of the ribbon onto a double-slot slider; inserting an intermediate portion of the ribbon into said slider by a first punch, temporarily deforming the slider arms; removing said punch leaving said ribbon intermediate portion beyond said arms; further comprises the step of temporarily resiliently deforming said ring, so that the latter is of sufficient width for allowing the passage of the substantially undeformed ribbon prior to slipping or threading the latter into the ring.

According to another feature, the process comprises, following said step of inserting an intermediate portion of the ribbon, the step of spreading or stretching out the ribbon thus inserted astride the slider arms by a second punch moving transversely of the ribbon, the latter being retained by spaced apart pliers during said operation.

The novel apparatus comprises a ribbon feeding unit; a slider supplying unit; a slider sealing or welding unit for welding the slider to the ribbon; a ribbon translation and turnover unit; and an insertion unit for inserting the ribbon into the slider.

According to further features, the apparatus comprises a supply and deforming unit for the rings and a ribbon cutting unit.

The novel process and apparatus enable a completely automatic assembling of an adjustable length shoulder-strap for clothing, completed with a ring and a slider and ready for attachment to the clothing item, which assembly takes place in short times, does not involve any labour, except but for control, and is highly reliable.

The foregoing and further features of the invention will be hereinafter described with reference to the accompanying drawings, in which:

FIG. 1 is a plan view showing three elements to be assembled, namely a slider, a ring and a ribbon, prior to assembling or manufacture;

FIG. 1*a* is a perspective view of a shoulder-strap as manufactured from the elements of FIG. 1;

FIGS. 2 to 13 are views showing the successive steps in an assembling process for manufacturing of shoulder-straps from the elements of FIG. 1; the figures comprise parts of the apparatus (to be described in the following); the apparatus parts are highly schematically shown; the process steps of FIGS. 2, 3, 4, 5, 6, 7 and 8 are shown from a point of view according to a plane through line 2—2 of FIG. 14, but on a different scale; FIG. 9 is shown according to plane 9—9 in said FIG. 14; and FIGS. 10 to 13 are shown as seen from a plane 10—10 of FIG. 20;

Figure 4:
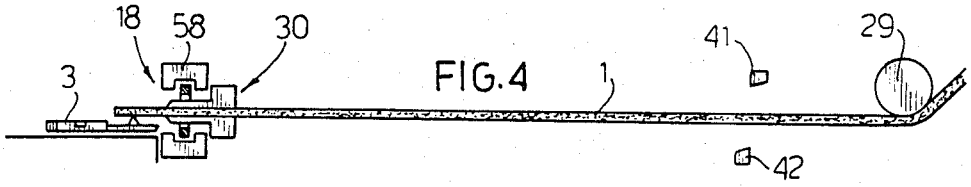
Figure 5:
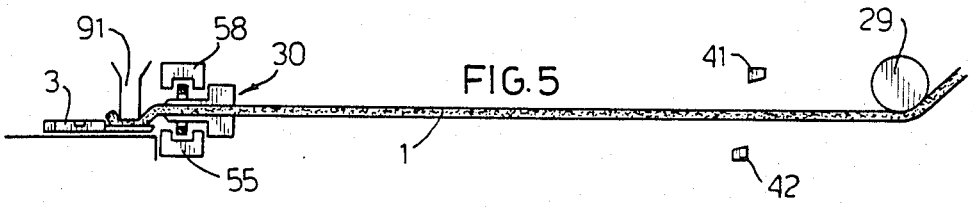
Figure 6:
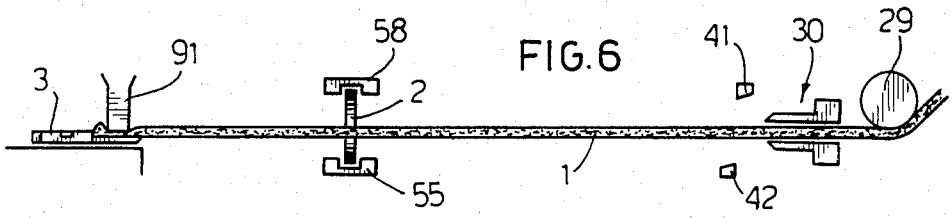
Figure 8:
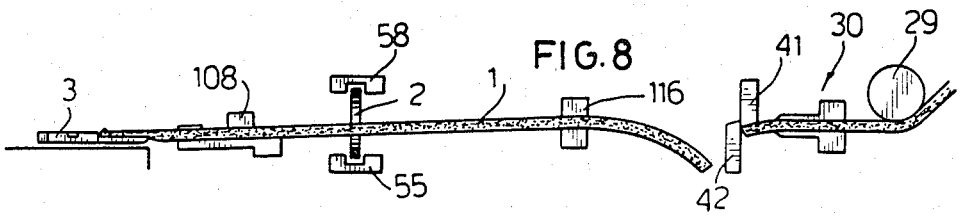
Figure 9:
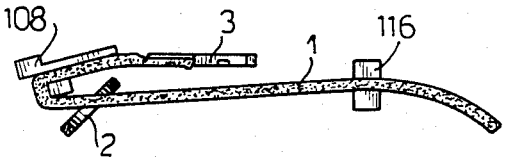
Figure 10:
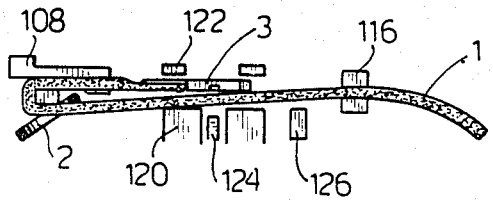
Figure 11:
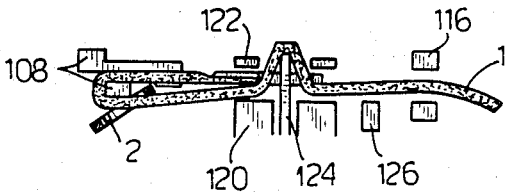
Figure 12:
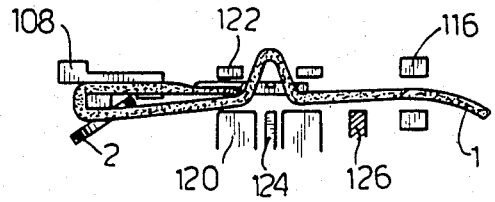
Figure 13:
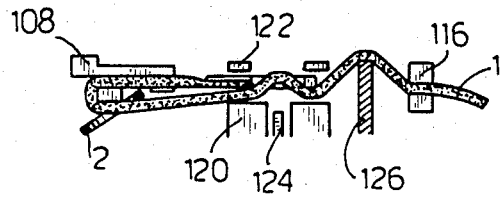
Figure 14:
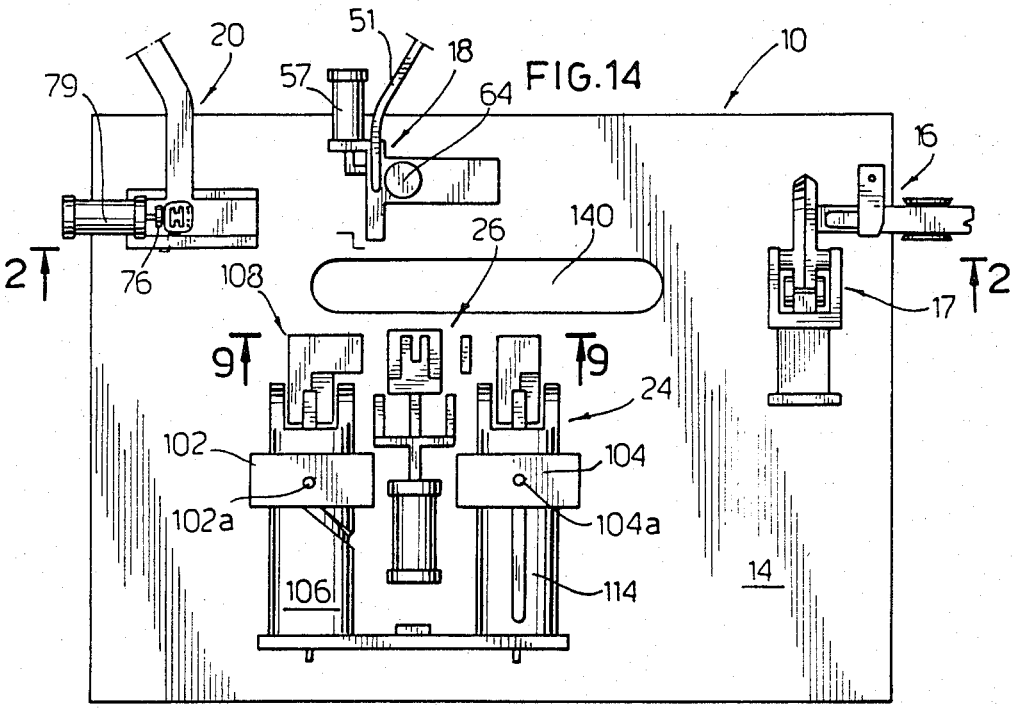
FIG. 14 is a schematic plan view of the apparatus, shown at a starting condition or step in the shoulder-strap manufacture or assembling and with some parts removed, with a ribbon ready for assembling.
Figure 15:
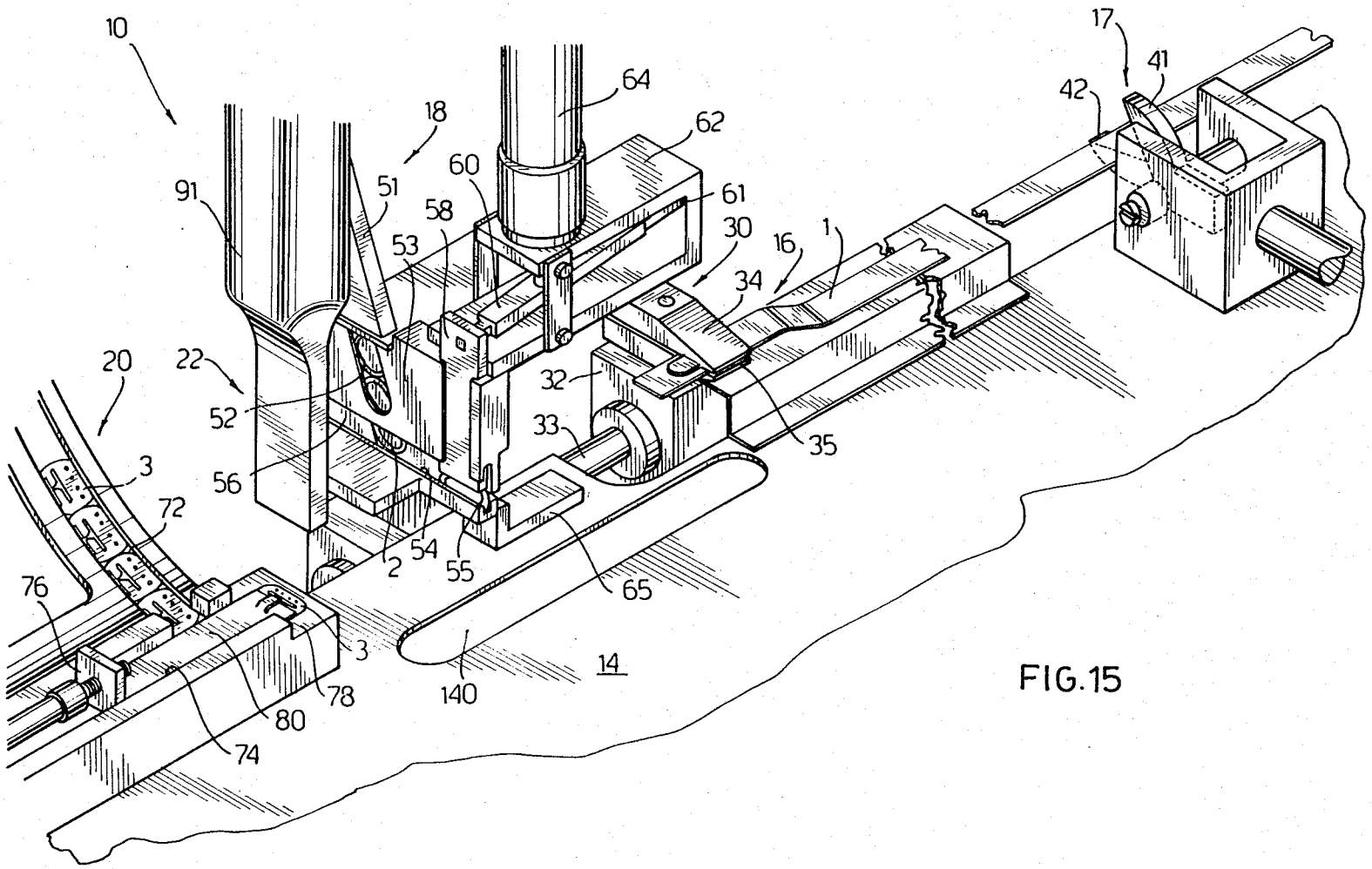
FIG. 15 is a perspective view of a part of a machine shown at a step subsequent to that of FIG. 14.
Figure 15A:
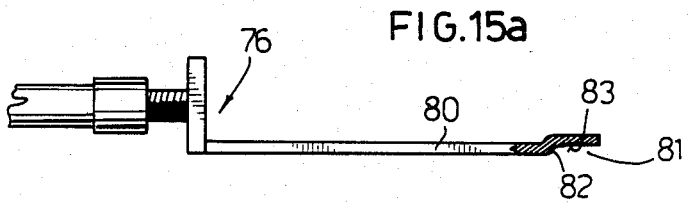
Figure 15B:
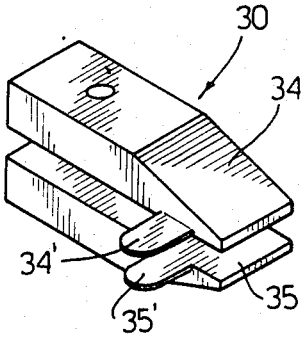
Figure 16:
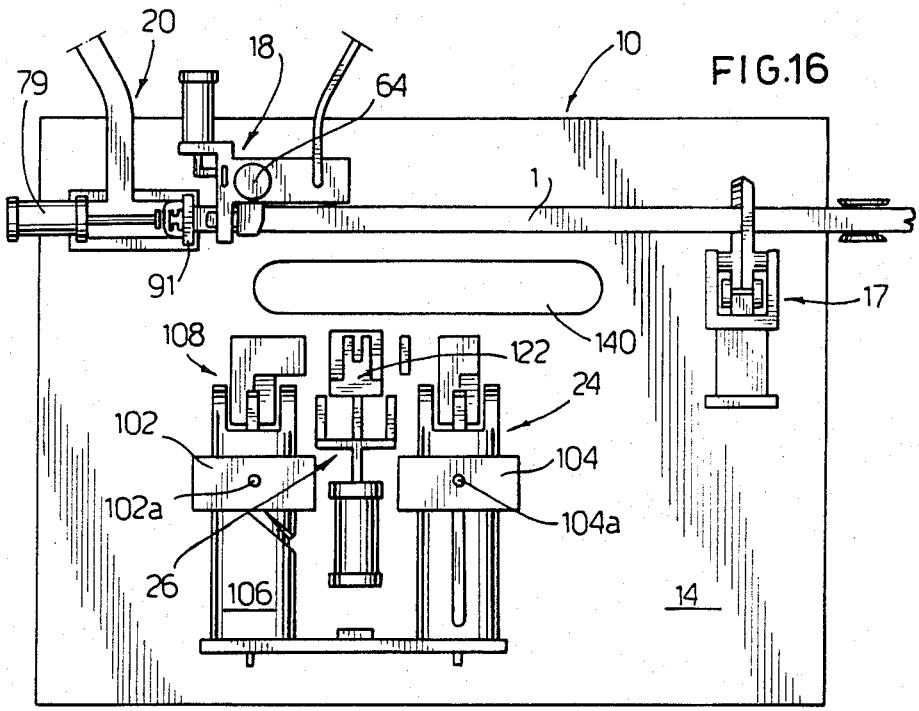
Figure 17:
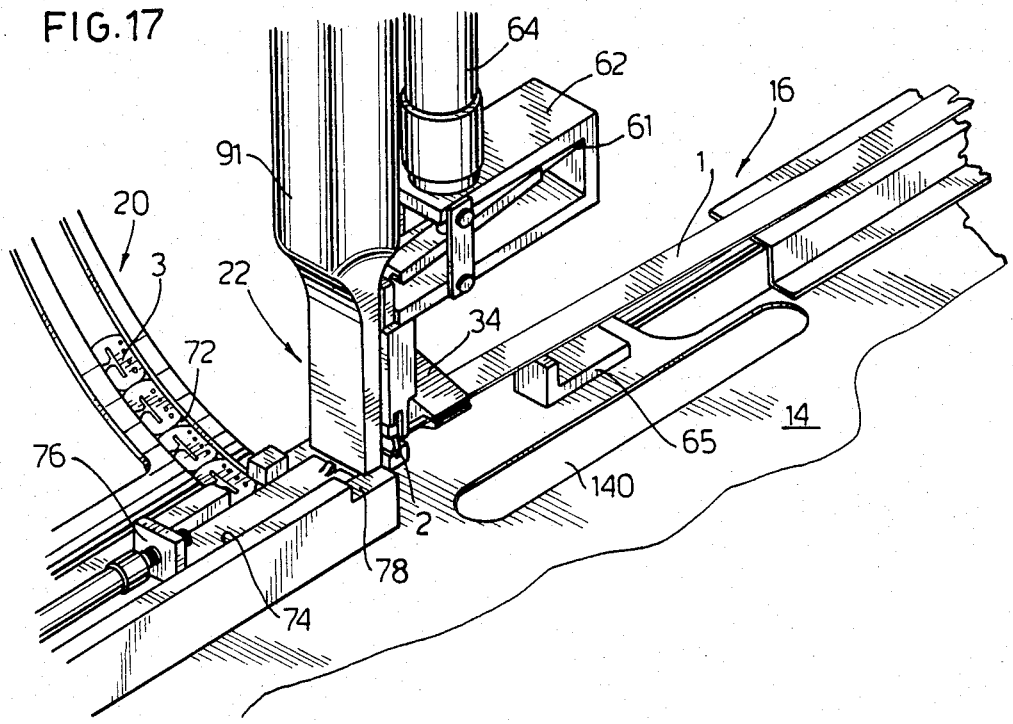
Figure 18:
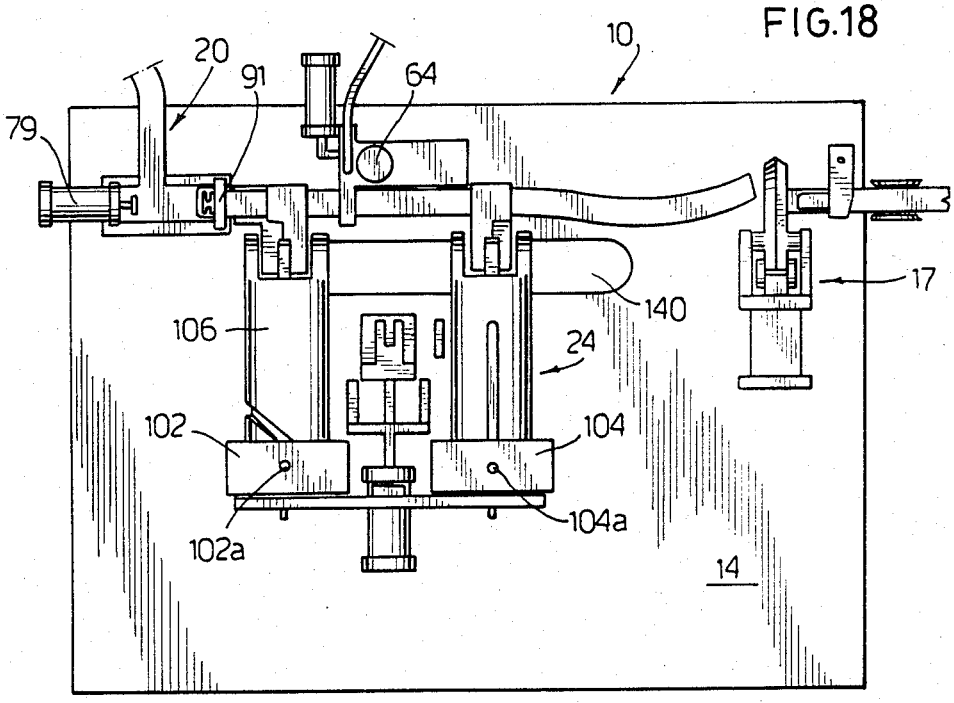
Figure 19:
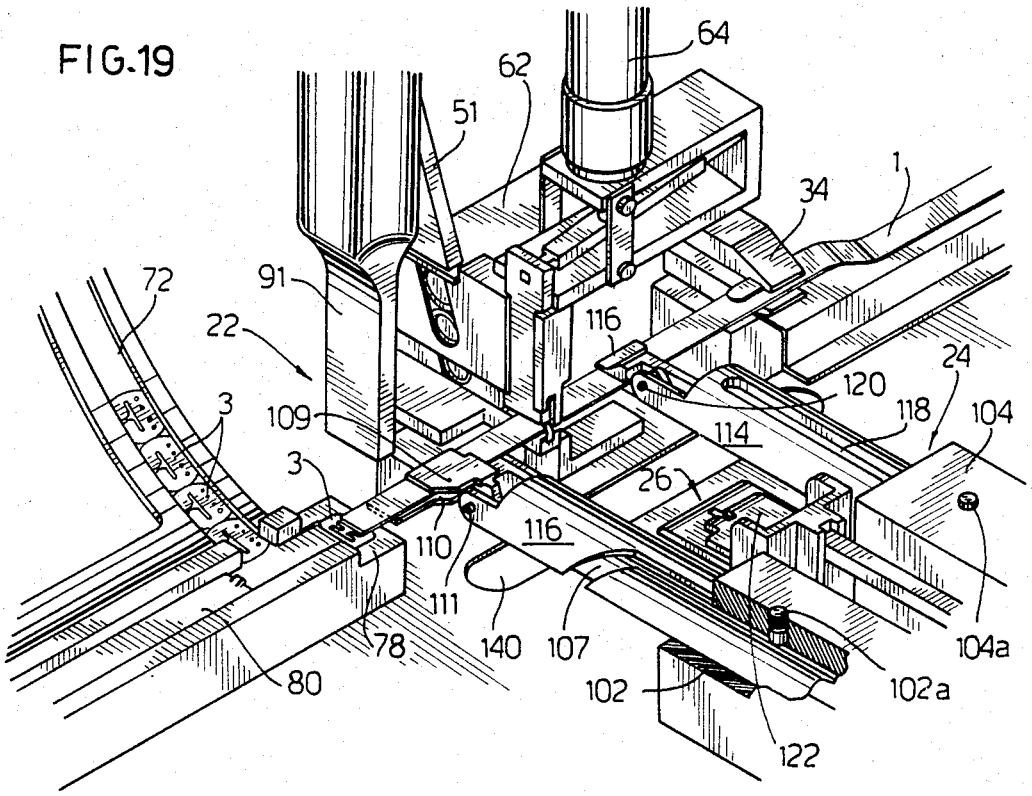
Figure 19A:
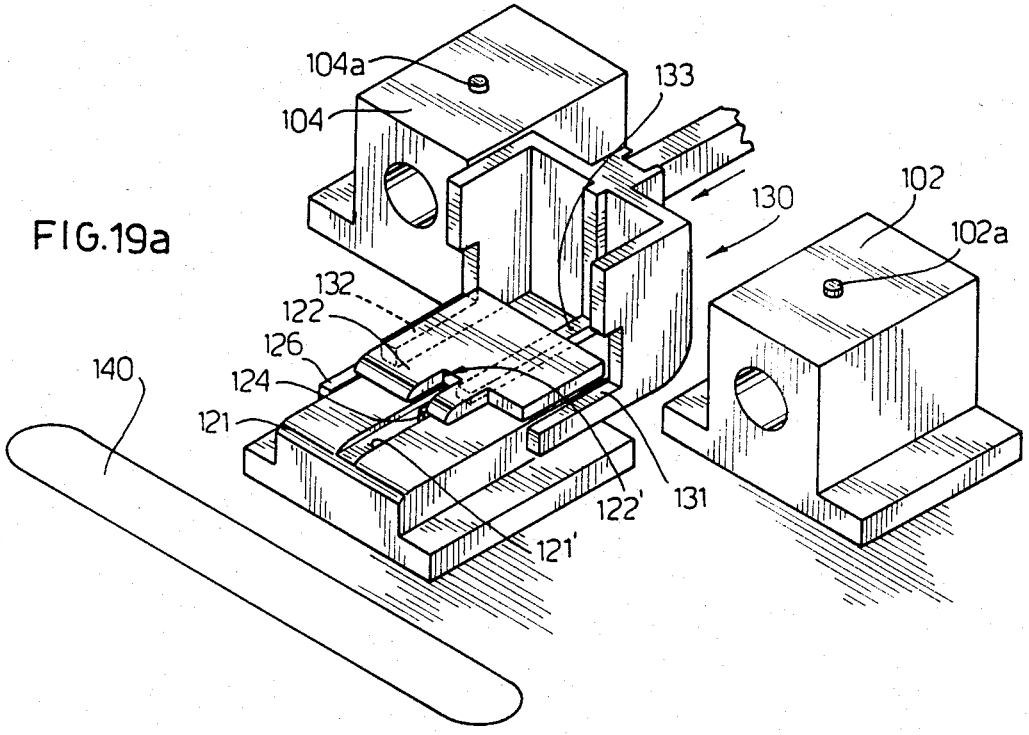
Figure 20:
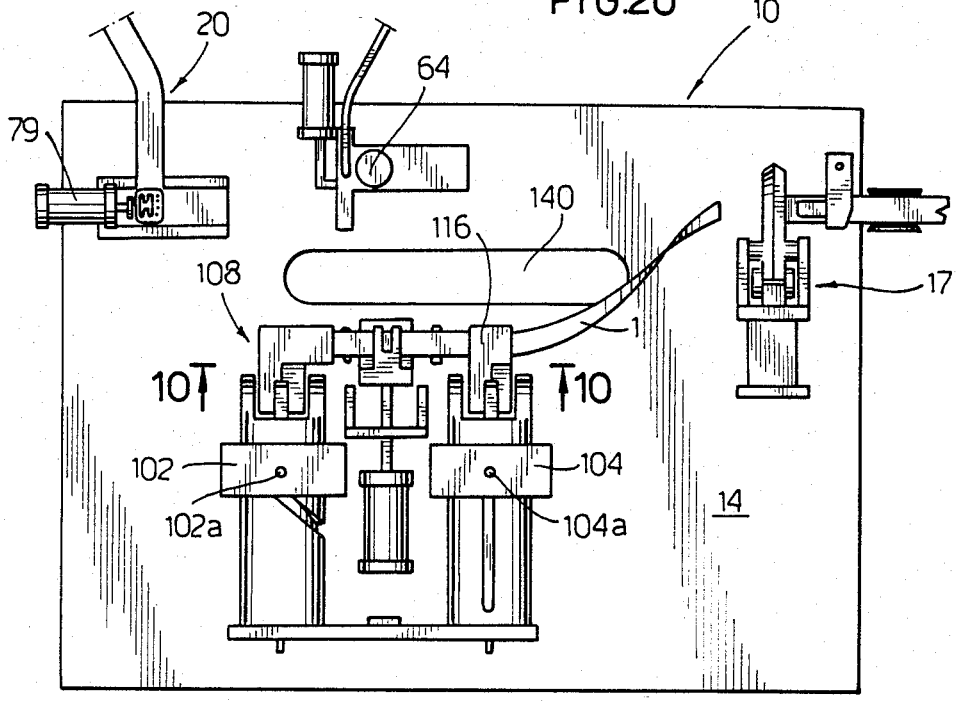
Figure 21:
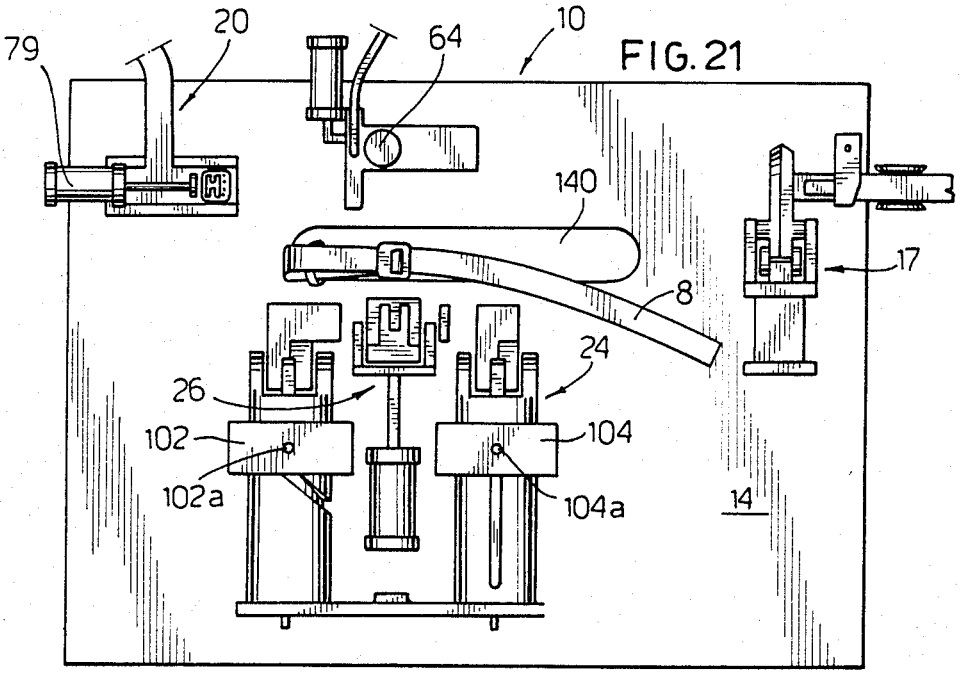
Figure 22:
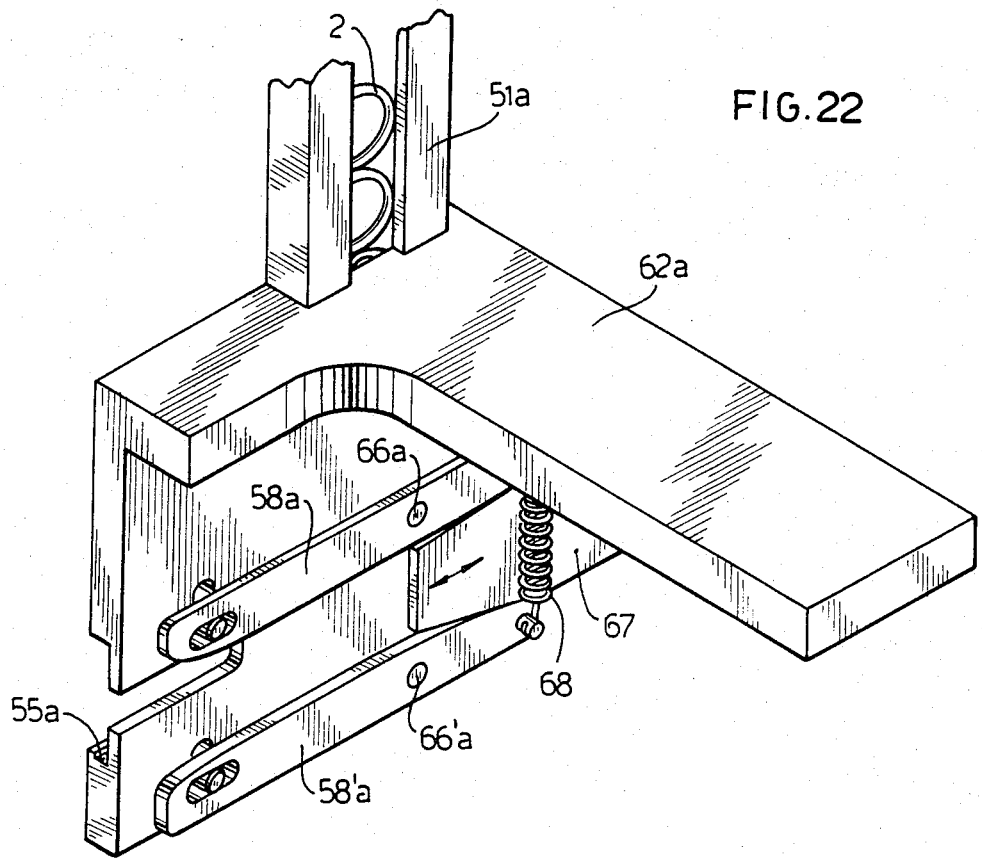

FIG. 15*a* is a view showing a detail of FIG. 15;

FIG. 15*b* is a view showing a detail of FIG. 15;

FIG. 16 is a plan view of the apparatus at a further step of the process, corresponding to FIGS. 4 and 5;

FIG. 17 is a perspective view of the apparatus at the step shown in FIGS. 4, 5 and 16;

FIG. 18 is a plan view of the apparatus at the step of the process corresponding to FIG. 8;

FIG. 19 is a perspective view of the apparatus at the step of FIGS. 8 and 18;

FIG. 19*a* is a perspective view showing a detail of the apparatus;

FIG. 20 is a plan view of the apparatus at a step corresponding to FIGS. 10, 11, 12 and 13;

FIG. 21 is a plan view of the apparatus at an ejection step of the completed shoulder-strap;

FIG. 22 is a perspective view of a modified device for ring squeezing; and

Figure 23:
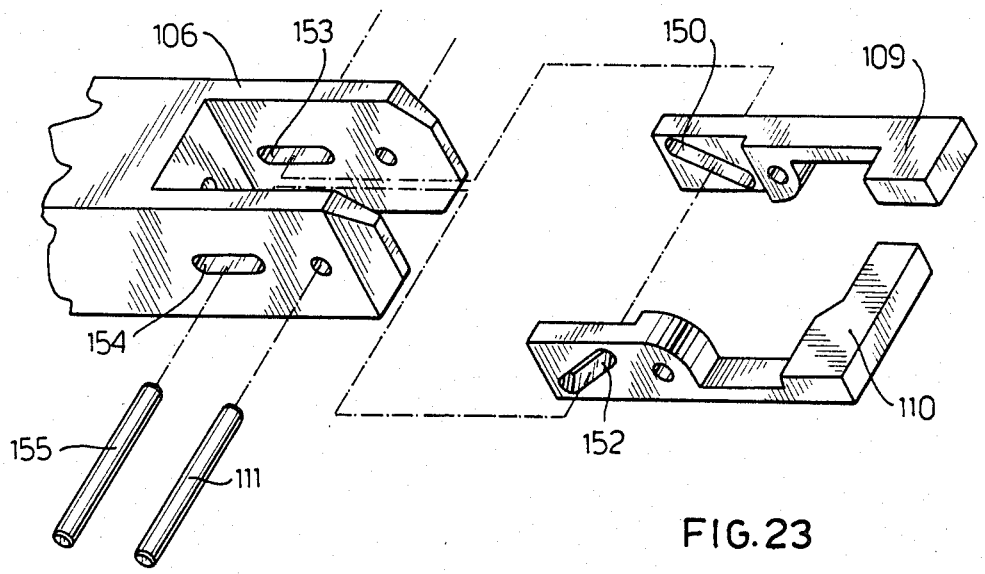

FIG. 23 is an exploded perspective view of a translation pliers member.

Figure 1:
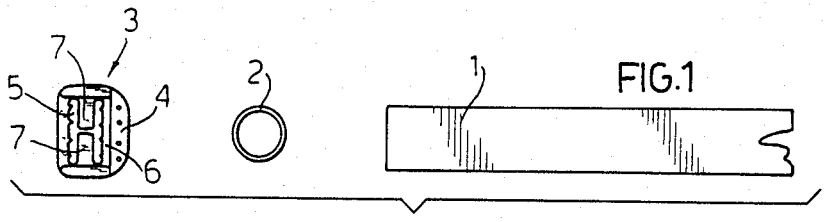
Figure 1A:
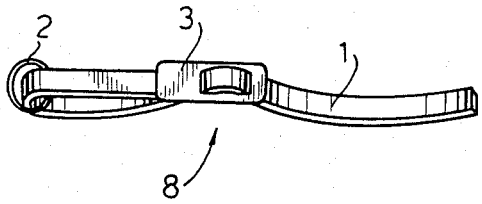
Figure 2:
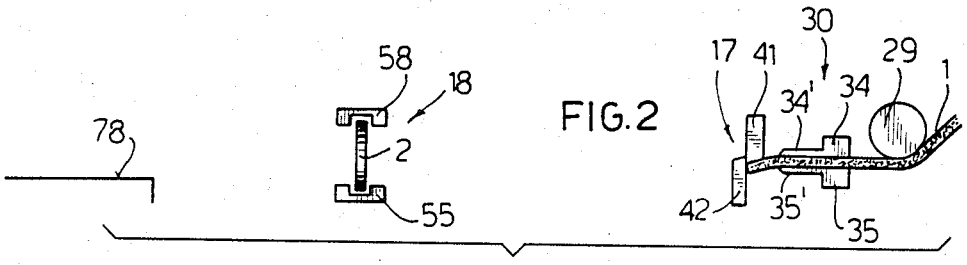
Figure 3:
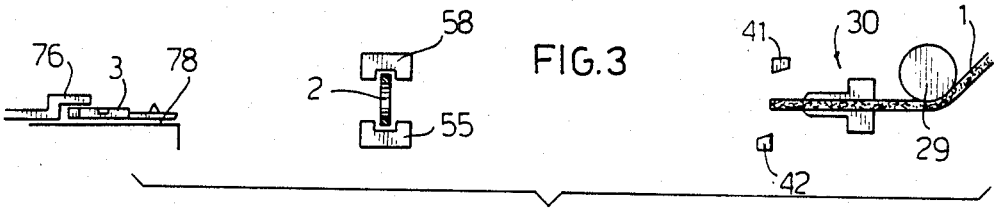

According to the invention and referring to FIGS. 1 and 21, a shoulder-strap 8 to be manufactured comprises an elastic or non elastic ribbon 1 of any known type; a ring 2 of relatively flexible and resilient material and diameter generally less than or equal to the ribbon width; and a slider 3 of the type as described in the above mentioned earlier application, that is comprising an anchoring portion 4 for anchoring by welding or sealing, slots 5 and 6 separated by elastically deformable arms 7. Said ring 2 may be substituted for by a hook element or slider of any known type.

Referring to the figures of the accompanying drawings, a shoulder-strap manufacturing apparatus 10, on a frame having a work table 14, comprises a ribbon feeding unit 16, a scissors 17, a ring supplying and squeezing (deforming) unit 18, a slider supply unit 20, a welding or sealing unit 22, a ribbon translation and turnover unit 24 and an inserting and ejecting unit 26 for inserting the ribbon into the slider and ejecting the shoulder strap.

Such units will be individually described in the following. It should be noted that such terms as horizontal, vertical, over, under, right, left and the like are herein used only for convenience of description with reference to the illustrations of the apparatus and not in a limiting sense.

Ribbon feeding unit (FIGS. 2–8, 14, 15, 15*b*)

The unit 16 comprises a supporting means (not shown) for the supply of a shoulder-strap ribbon 1, for example from a commercially available continuous roll unwound about a roller 29; it further comprises a pliers member 30, or feeding pliers, carried on a block 32 movable on a generally horizontal guide 33 for to and fro travel. Said pliers member 30 comprises jaws 34 and 35 openable to each other in any well known manner (not shown); each of said jaws 34 and 35 have at the portion thereof facing the units 18 and 22 a supporting extension integral thereto, respectively 34' and 35' and relatively flat and thin, so that said ribbon 1 can be gripped and held with an end portion thereof substantially horizontally arranged. The pliers member is movable between an extreme position beyond the scissors 17, shown in FIGS. 2, 3, 6, 7, 8, 14 and 18, and an extreme position adjacent unit 20, shown in FIGS. 4, 5, 16 and 17. In FIG. 15 such a member is shown at an intermediate position.

Scissors (FIGS. 2–8, 14, 15, 16, 18, 20, 21)

The scissors 17 are mounted at an adjustable position on the frame adjacent and slightly downstream of the extreme position for pliers 30. The scissors 17 comprise a pair of blades 41 and 42 which, at the open condition thereof, leave a free space therebetween sufficient for the passage of pliers 30. Opening and closing of the scissors blades is controlled by any well known system to those skilled in the art, for example by a pantograph system controlled by a cylinder-piston.

Ring supply and squeezing unit (FIGS. 2–8, 14–22)

The supply unit 18 for supplying rings 2 generally comprises a vibrating feeder, not shown as per se well known, from which the rings 2 aligned one by one are supplied to an inclined guide 51 and therefrom along an inclined channel 52 provided in a side wall 53 of the unit to a substantially horizontal channel 54. Along the latter each ring is individually pushed by an inclined edge pusher 56, having an horizontal reciprocating motion into a seat 55 at the end of said channel 54. The pusher is to and fro driven in any well known manner, for example by cylinder-piston 57 shown in FIG. 14. A slide 58 is vertically slidable on seat 55 and is reciprocated in vertical direction by any well known means. For example, said slide 58 is coupled to a lever 60 pivoted at 61 to a frame 62 of the ring feeding unit. A cylinder-piston assembly 64 acts upon said lever 60 and causes said lever and accordingly said slide 58 to be lowered and lifted; on lowering, said slide causes by its lower edge some squeezing of the underlying ring. The whole frame 62 of the ring supply and squeezing unit is movable for a to and fro movement to and away from the unit 22 and is carried and guided for movement on the above mentioned guide 33 or on another parallel guide. A piece 65, secured at adjustable position on table 14, acts as a stop of for said frame 62.

According to a modified embodiment shown in FIG. 22, each ring 2 supplied from a channel 51*a* to a seat 55*a* is squeezed between two vertically movable slides (not shown), each of which connected to an arm or lever 58*a* and 58'*a*, respectively. Each arm is pivoted on the frame 62*a* respectively at 66*a* and 66'*a*. A wedge 67, movable in the direction shown by the arrows, provides for convergency of the slides, while a spring 68 provides for maintaining such slides away from each other.

The whole unit 18 may be modified when said rings 2 are substituted for by other equivalent devices, such as hook sliders or rectangle rings.

Slider feeding units (FIGS. 14, 15, 15*a*, 16, 17, 18, 19, 20, 21)

The unit 20 generally comprises a vibrating device (not shown, as per se well known), from which the sliders 3 are orderly supplied one by one to an inclined channel 72, arriving therefrom by gravity at a horizontal channel 74 which is transverse to channel 72. A pusher member 76 in said channel 74 provides for carrying and individually positioning each slider on a welding or sealing seat 78 at the channel end. Said pusher 76 is driven by a cylinder-piston assembly 79 and has a plate 80 having a lower offset 81, so that a shoulder 82 of the plate provides for support of the slider against longitudinal movement and an upper shoulder 83 prevents the slider against vertical displacement.

Welding or sealing unit (FIGS. 5, 6, 7, 15, 16, 18, 19)

The welding or sealing unit 22 may be any well known unit suitable for the intended purpose; particularly, in the example shown, it comprises a horn or ultrasonic welding tool (soundtrode 92), having a substantially rectangular operative surface and arranged on the vertical of seat 78 and vertically movable. A control device (not shown), for example a photocell device, controls the presence of a slider 3 in seat 78 and enables soundtrode or tool lowering.

Ribbon translation and turnover unit (FIGS. 7–13, 14, 16, 18, 19, 19*a*, 20, 21, 23)

Two blocks 102 and 104 are mounted on the work table 14. A body 106 of a translation pliers member 108 is slidable within block 102 between extended and retracted positions. Said body 106 has a groove 107 of helical shape on at least part of its extent, for engagement with a fixed pin 102*a* projecting into said body 102 so that, when body 106 moves from extended to retracted position, it also rotates about its own axis through about 180°. Pliers 108 comprise two jaws, an upper jaw 109 and a lower jaw 110, which are substantially flat and suitable to be arranged on one side and the other of ribbon 1. Both of the jaws are pivotally supported on body pin 111, and can rotate thereabout to pass from opening to closing positions. An opening and closing mechanism may be of any well known type, for example as shown in FIG. 23. Said two jaws are provided on the shanks thereof with slots 150 and 152 inclined in opposite direction; on the two opposite sides said body 106 has slots 153 and 154 axially extended, so that a second pin 155 engaged in said slots 150, 152, 153 and 154 and to and fro moved causes the opening and closing of the jaws.

A body 114 of a second translation pliers member 116 is slidable within block 104. This body 114 is movable between an extended position relative to block 104 and a retracted position in said block 104; in the body an axial rectilinear groove 118 engages with a pin 104*a* projecting into said block 104 to guide the rectilinear movement of said body 114. The two jaws of said pliers 116 are pivoted about the pin 120 on said body 114; opening and closing thereof is controlled by any well known means, for example as above described in connection with FIG. 23. The bodies 106 and 114 are integral to each other when advancing and the advancement or feeding may be controlled by per se well known means, not shown.

Insertion unit for the ribbon in the slider and ejection (FIGS. 14, 16, 18, 19*a*, 20)

The unit 26 comprises a plate 121 and a counter-plate 122 secured to said table 14. Plate 122 is superimposed to plate 121 and substantially parallel thereto, spaced apart therefrom by a gap at least sufficient to accommodate the thickness of two plies of ribbon 1.

Both of said plates have aligned through apertures 121' and 122'. A first punch 124 is movable at right angles to the extension of said plates and is of such a size as to loosely pass through said apertures and slider. A second punch 126 is also movable orthogonally of said plates and is arranged spaced apart from the first punch. The operating means for said first and second punches are not shown as per se well known.

For the ejection of the completed shoulder-strap there is provided an ejector means 130; in the embodiment shown in FIG. 19*a* said means 130 is of fork type and has two side arms 131 and 132 on the sides of plates 121 and 122 and a central arm 133 arranged between the plates.

Alternatively, said ejector 130 may comprise only said arm 133. The ejector device 130 is movable between an advanced position, at which it provided for ejection of the completed shoulder-strap, and a retracted position (shown in FIG. 19*a*) at which it does not interfer with the shoulder-strap; the movement is imparted by known means (not shown). The ejected shoulder-strap 8 is allowed to fall down into an aperture 140 and collected in a suitable collection vessel or device, not shown. The apparatus further comprises control means, not described in detail as per se in the reach of those skilled in the art, to allow the continuation of the operation only in the presence of such elements as ribbon, ring, slider, as required thereto.

The process according to the invention will now be explained, while describing at the same time the operation of the apparatus.

One end of a continuous shouder-strap ribbon 1 (said end having been sheared by scissors 17) is initially placed within said pliers 30 which are closed and retain it. A ring 2 is supplied to seat 55 and by exploiting the elasticity thereof is deformed by slide 58; the temporary deformation of said ring sufficiently increases the width size thereof so that the ribbon 1 can be easily passed therethrough.

A slider 3 is supplied to seat 78 and retained thereon. The above described steps are shown in FIGS. 2, 3, 14 and 15.

At open scissors 17, feeding of the pliers 30 is initiated. The pliers 30 support the end of ribbon 1, at horizontal arrangement between the extensions 34' and 35' and with a border projecting therefrom; the pliers 30 move between the open blades of scissors 17 and translate to the left as seen in the figures of the drawings; then encounter the unit 18 and provide for shipping or threading the end of said ribbon 1 into the ring 2 deformed between said slide 58 and seat 55; the pliers 30 then continues to advance to the left as seen in the figures of the drawings, accompanied by unit 18, up to a position (FIGS. 4, 5 and 17) adjacent the slider seat 78. The units 30 and 18 stop and the end of ribbon 1 is positioned over the anchoring portion of a slider present on said seat 78.

This position is shown in FIGS. 4 and 17.

The tool or soundtrode 91 is lowered and welds or seals the slider to the ribbon (FIGS. 5 and 16). On lowering of the soundtrode to hold the ribbon, pliers 30 open. The pliers 30 move back to the initial position unit 18 moves back to initial position and pressure is released on ring 2 (situation of FIG. 6).

At the initial position said pliers 30 close, gripping again said ribbon 1.

Figure 7:
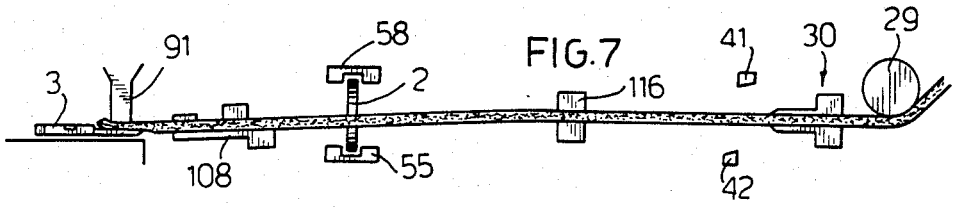

The pliers 108 and 116 move forward gripping the ribbon 1 between the units 20 and 18 and between the units 18 and 16, respectively (FIGS. 7, 18, 19).

The scissors 17 cut away said ribbon 1 adjacent said pliers 30 FIGS. 8 and 18); the soundtrode is raised.

The pliers 108 and 116 are retracted to displace the ribbon, completed with slider and ring, moving it transversely away from the position hitherto occupied towards said plates 121 and 122. At the same time, pliers 108 rotate through 180° about its own body 106, bending said ribbon 1 as loop and bringing the slider to bear on an intermediate portion of ribbon 1, (FIG. 9) which bears on the extended portion of plate 120; ring 2 remains in the loop portion; as the retraction movement of pliers 108 and 116 continues, the intermediate portion of ribbon 1 with the superimposed slider is inserted into the gap between plates 121 and 122, with the slider arm in register with the superimposed apertures of the plates (FIGS. 10 and 19*a*); the first piston 124 is at retracted condition, as well as also the second piston 126.

Pliers 116 are opened; then the punch 124 is extended (FIG. 11) causing the intermediate portion of the ribbon to be inserted into the slider, deforming the arms of the latter.

The punch 124 is then retracted, leaving the ribbon astride the arms; now the ribbon forms a loop (FIG. 12) on the slider arms.

The pliers 116 are closed again and the second punch 126 is operated (FIG. 13) to stretch the ribbon removing the above mentioned loop.

The punch 126 is then retracted (this step not being shown) and the ejection fork is advanced to eject the shoulder-strap thus formed from the gap between said plates 121 and 122, pushing it over the aperture where the shoulder-strap falls to the collection container. It should be noted that in a continuous process the operations restart from the step shown in FIG. 8.

What I claim is:

1. A process for manufacturing adjustable shoulder-straps comprising a ribbon length, a slidable ring and a slider attached to one end of the ribbon and on which the ribbon can slide with another portion thereof for adjusting the length of the shoulder-strap, said slider being of a type sealable or weldable to the ribbon and having resiliently deformable arms extended to one another to define ribbon sliding slots; said process comprising the steps of: threading the ribbon into said ring; sealing or welding one end of the ribbon onto said slider; threading an intermediate portion of the ribbon into said slider by a first punch, while temporarily deforming said arms; and removing said punch leaving said intermediate portion of the ribbon beyond said arms; wherein the step is provided of temporarily resiliently deforming said ring, to have a sufficient width for the passage of the substantially undeformed ribbon prior to threading the ribbon into the ring.

2. A process for manufacturing adjustable shoulder-straps comprising a ribbon length, a slidable ring and a slider attached to one end of the ribbon and on which the ribbon can slide with another portion thereof for adjustment in length of the shoulder-strap, said slider being of a type sealable or weldable to the ribbon and having resiliently deformable arms extended to one another to define ribbon sliding slots, said process comprising the steps of: threading the ribbon into said ring; sealing or welding one end of the ribbon onto said slider; threading an intermediate portion of the ribbon into said slider by a first punch, while deforming the arms; removing said punch leaving said intermediate portion of the ring beyond said arms; wherein subsequently to said step of threading an intermediate portion of the ribbon, the operation is provided of spreading the ribbon thus threaded astride the slider arms by a second punch advancing transversely of the ribbon, the ribbon being retained during said operation by spaced apart pliers.

3. A process according to claim 1, wherein said step of threading the ribbon comprises the step of gripping one end of the ribbon by a pliers member, moving said pliers towards said ring and partly introducing said pliers with the ribbon into the ring, said process further comprising the step of moving said pliers, ribbon end and ring near the sealing or welding location, then releasing the ribbon while sliding said ring along the ribbon moving it away from the sealing or welding location.

4. An apparatus for the manufacture of adjustable shoulder-straps, comprising a ribbon length, partly folded up as a loop, a slidable element retained in said loop, a slider welded to one end of the ribbon and slidably engaged on an intermediate portion of the ribbon, so as to close said loop, wherein there are provided: a ribbon feeding unit; a slider supply unit; a sealing or welding unit for sealing or welding the slider to the ribbon; a ribbon translation and turnover unit; and an insertion unit for inserting the ribbon into the slider, said ribbon translation and turnover unit comprising first and second translatable pliers, both of which have extension and retraction movement imparted thereto transversely of the ribbon extent, said first pliers being also rotatable about an axis parallel to the direction of extension and retraction of said first pliers.

5. An apparatus according to claim 4, for ring-link slidable elements, wherein a ring supply unit is provided.

6. An apparatus according to claim 4, wherein a ribbon cutting unit is provided.

7. An apparatus according to claim 5, wherein said ribbon feeding unit comprises: a pliers assembly movable towards and away from said ring supply unit and said sealing or welding unit; said pliers having two jaws and an extension integral with each jaw, said two extensions being substantially coextended and substantially thin to carry the ribbon while threading the latter into a ring.

8. An apparatus according to claim 5, wherein said ring supply unit comprises a ring deforming means.

9. An apparatus according to claim 8, wherein said ring deforming means comprise a seat to accommodate a supplied ring and a slide approachable to said seat to sequeeze said ring between said seat and slide.

10. An apparatus according to claim 8, wherein said ring deforming means comprise a pair of slides approachable to each other on opposite sides of an interposed ring, said slides being driven by levers pivoted on a frame of said deforming means, and closed to each other by a movable wedge means against the action of a spring means.

11. An apparatus according to claim 5, wherein said ring supply unit comprises an inclined channel for supplying rings by gravity and a pusher means which is movable transversely of said inclined channel and is located at the end thereof.

12. An apparatus according to claim 5, wherein said ring supply unit is movable towards said sealing or welding unit along with said ribbon feeding unit.

13. An apparatus according to claim 4, wherein said slider supply unit comprises an inclined channel and a pusher movable transversely of the end of the inclined plane, said pusher having an offset shaped pushing bar to retain a slider on one seat on one side and on the upper surface.

14. An apparatus according to claim 4, wherein said sealing or welding unit comprises a soundtrobe or tool for ultrasonic welding.

15. An apparatus according to claim 4, in which said first and second translatable pliers are mounted for conjoint extension and retraction movement.

16. An apparatus according to claim 4, wherein said insertion unit for the ribbon in the slider comprises: a lower plate; an upper plate spaced apart from said lower plate to define a gap therewith of a sufficient size to accommodate a folded up ribbon with a welded slider; both of said plates being provided with a through aperture, said apertures being coincident with each other; and a first punch movable transversely of said plates and passing through said aperture.

17. An apparatus according to claim 16, wherein a second punch is further provided spaced apart from said first punch and movable transversely of said plates.

18. An apparatus according to claim 16, wherein an ejector unit is further provided, which in turn comprises at least one arm interposed and movable between said plates.

* * * * *